United States Patent [19]

Mileti

[11] Patent Number: 5,002,423

[45] Date of Patent: Mar. 26, 1991

[54] CONNECTOR FOR BARRIER MODULE

[75] Inventor: Robert A. Mileti, Andover, Mass.

[73] Assignee: Fitch Barrier Corporation, Huntington, N.Y.

[21] Appl. No.: 410,404

[22] Filed: Sep. 21, 1989

[51] Int. Cl.[5] ..... E01F 15/00

[52] U.S. Cl. ..... 404/6; 256/13.1

[58] Field of Search ..... 404/6–9; 138/156; 256/13.1, 26

[56] References Cited

U.S. PATENT DOCUMENTS

| | | | |
|---|---|---|---|
| 822,004 | 5/1906 | Kronauer | 138/156 |
| 1,185,014 | 5/1916 | Shea | 52/472 |
| 2,116,426 | 5/1938 | Cecil | 407/7 X |
| 2,386,297 | 11/1945 | Slaughter | 62/29 |
| 3,587,657 | 6/1971 | Staller | 138/156 |
| 3,606,258 | 9/1971 | Fitch | 404/6 X |
| 3,788,001 | 1/1974 | Balfanz, Jr. | 404/7 X |
| 3,856,268 | 12/1974 | Fitch | 256/13.1 |
| 4,084,066 | 4/1978 | Gillemot | 138/156 X |
| 4,777,072 | 10/1988 | Cason, Jr. | 428/120 |

*Primary Examiner*—Thuy M. Bui

*Attorney, Agent, or Firm*—Nies, Kurz, Bergert & Tamburro

[57] ABSTRACT

A cylindrical impact attenuator in which two semi-cylindrical halves have flanged and ribbed edges joined by slidably installed connector strips.

11 Claims, 1 Drawing Sheet

CONNECTOR FOR BARRIER MODULE

BACKGROUND OF THE INVENTION

The present invention relates to impact attenuators of the type now in widespread use to control the rate of deceleration of an errant vehicle as it approaches a hazardous fixed object in the highway environment. One of the more successful of these devices is disclosed in U.S. Pat. No. 3,606,258. That device, comprises an array of frangible containers or barrier modules each containing a dispersible mass, such as sand, which is located such that its center of gravity is elevated to that level which simulates the center of mass of the average vehicle.

The lower portion of the modules contain a lightweight core assembly and the upper portion is filled with the dispersible mass. In a typical case, the modules may have a diameter of approximately 36 inches and a height of approximately 36 inches. The weight of the modules, which may be varied to suit the requirements of a particular installation, ranges from some four hundred pounds to over two thousand pounds. The individual modules must have sufficient strength to retain the sand load without fracture or deformation and yet be sufficiently fragile so that on impact by a vehicle they will break up to permit dispersion of the sand without the formation of large relatively heavy pieces which would be hazardous to other persons or vehicles.

As disclosed in the '258 patent, and as actually manufactured, the individual modules are constructed in two identical halves, one edge of each half being formed with a flange overlapping the edge of the adjacent half, the parts being secured together by rivets. Typically twelve integrally molded holes are provided in each flange to accommodate the rivets. While this connection has adequate initial strength it is subject to premature failure resulting from stress concentration around the rivet holes.

SUMMARY OF THE INVENTION

The object of this invention is to substantially increase the strength and durability of the barrier module without detracting from the performance of the barrier when impacted by an errant vehicle.

It is a more specific object of this invention to improve the strength of the sand-filled inertial barrier described in U.S. Pat. No. 3,606,258 by eliminating the need for rivet holes to hold the two cylinder halves together, these rivet holes constituting the weak link in the assembly.

It is also an object of this invention to simplify and shorten the assembly process for the module, thereby reducing the risk to maintenance workers who frequently accomplish this task in hazardous locations on the highway.

It is a further object of this invention to effect this improvement in static strength of the module without detracting from the performance of this barrier system which has been demonstrated throughout the many years it has been installed on highways.

In attaining these and other objects, the present invention provides an improved impact attenuator module comprising a pair of identical cylindrical halves joined together by a novel fastener which eliminates the need for rivets or similar fasteners which require holes in the cylinder halves.

In accordance with the present invention each edge of each cylinder half is formed with an integrally-molded flange which is radially outwardly offset from the main cylinder body. The flange terminates in an outwardly projecting rib. A connector strip, preferably of extruded plastic, is slidably installed over the flanges and ribs and over the adjacent inner surfaces of both cylinder halves, thereby clamping the edges together forming an entire cylinder.

DESCRIPTION OF THE PREFERRED EMBODIMENTS

Except for the novel mechanism for connecting the two cylinder halves together, the barrier modules with which the present invention is concerned are essentially the same as those disclosed in the aforesaid '258 patent.

Figure 1:
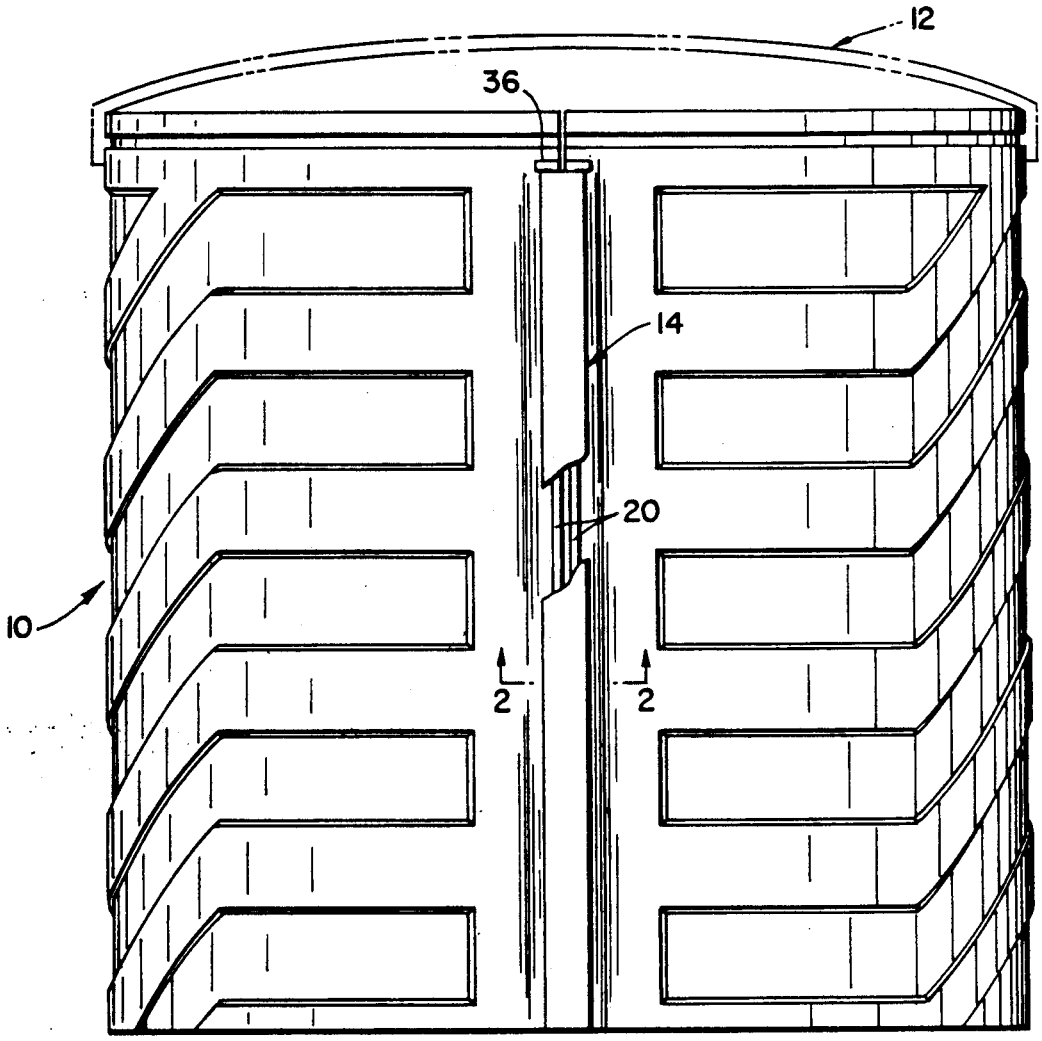
FIG. 1 is a side elevation of an assembled module showing one connector strip in place.
Figure 2:
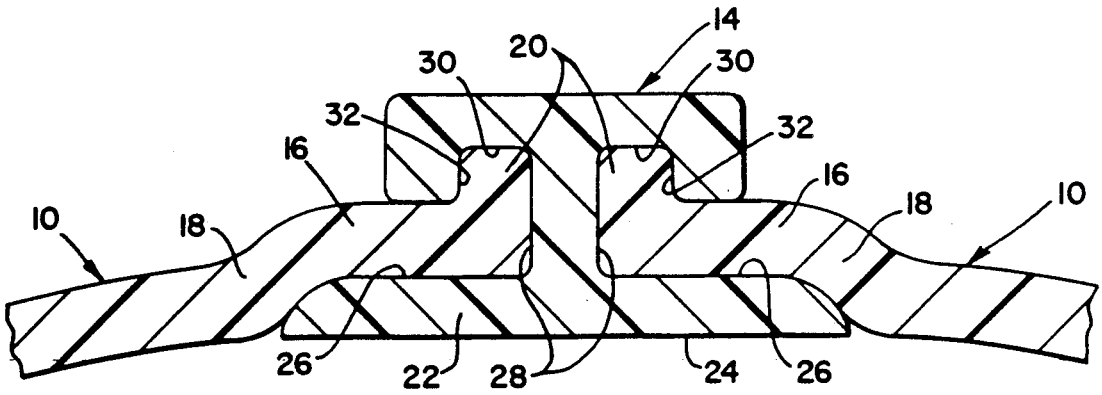
FIG. 2 is an enlarged section through the joint, taken along line 2—2 of FIG. 1.

As in the prior device the modules include two identical halves 10, each of semi-cylindrical form, and a detachable lid 12. In accordance with the improved construction of the present invention, the two halves are joined by one or more connector strips 14 which cooperate with flanges formed along the edges of the container halves as shown in greater detail in FIG. 2. As there shown the edges of the cylinder halves are formed with radially outwardly offset sections 16 joined to the main body section by a smoothly curved transition portion 18. A rib 20 projects radially outwardly from the edge portion of the offset section 16.

The connector strips 14 are of generally T-shape in cross section having an enlarged base 22, the inner surface 24 which essentially forms a continuation of the inner surface of the container. The body of the strip 14 is formed with surfaces 26, 28, 30, 32, and 34 which are adapted to engage with a close sliding fit the corresponding surfaces of the flange and rib structures.

In a typical case, the width of the base is 2.375", the height of the connector is 1.1" and the ribs 20 are 0.375" wide and project outwardly from the flanges 16, 0.215".

The connector strips may be of a length corresponding to the height of the module so that only two strips are required per module. However, to facilitate handling and installation it may be preferable to provide the strips in shorter lengths, for example, one-half or one-third of the height of the module, in which case four or six strips are required per module.

The cylinder halves 10 are preferably molded of polypropylene using a structural foam process, which has sufficient strength to contain the sand and yet is sufficiently frangible to break into small pieces when struck by an impacting vehicle. Connector strips 14 are preferably extruded from a stronger stiffer material such as ABS or PVC although less expensive materials may be used.

A balanced combination of shear strength, flexural strength and flexural modulus is required to resist failure of the strip 14 or disengagement of the flanges when the cylinder is subjected to membrane stresses caused by the internal pressures, both active and passive. The strip material must also have relatively low impact strength so that it will break into small pieces when the cylinder is struck by the errant vehicle. The strip material should also be resistant to ultra-violet radiation and have a coefficient of thermal expansion compatible with that of the cylinder halves.

To assemble the module, the two halves are placed on the road surface upside down with the flanges almost touching. First, on one set of flanges, one or more of the strips 14 are slid down along the flanges. The first strip will bottom on a molded stop 36 restricting further motion. The second strip or set of strips are then installed in a similar manner to the diametrically opposite set of flanges, thereby completing the assembly. The cylinder is then re-inverted so that it is right-side up ready to place over the module core which is also resting on the road surface.

The interior surface of the module is essentially cylindrical since the flange structure is offset outwardly to accommodate the base of the strip 14 without interferring with the placement over the core, yet maintaining a snug fit around 360 degrees of circumference, restricting the leakage of the sand within the cylinder.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cylindrical assembly with a longitudinal axis and comprising a pair of complementary semi-cylindrical sections terminating in edges extending parallel to the axis of said assembly, means forming a radially outwardly offset flange along said edges of each section, said flanges terminating in an outwardly projecting rib, and a connector strip engageable with the flanges and ribs on adjacent ones of said edges of said sections to hold said sections in assembled relation.

2. The assembly of claim 1 wherein said strip is adapted to slidably engage said flanges and said ribs.

3. The assembly according to claim 1 wherein said strip has a base engageable with the inner surfaces of said flanges, a surface of said base forming a continuation of the inner surfaces of said sections.

4. An essentially cylindrical impact attenuator module with a longitudinal axis and comprising a plurality of arcuate sections, each section terminating in edges substantially parallel to the axis of said module, means forming radially outwardly offset flanges along said edges of each section, said flanges terminating in an outwardly projecting rib, and connector strips engageable with the flanges and ribs on adjacent ones of said edges of said sections to hold said sections in assembled relation.

5. The module according to claim 4 wherein said strips are adapted to slidably engage said flanges and said ribs.

6. The module according to claim 5 wherein said strips have a base engageable with the inner surfaces of said flanges, a surface of said base forming a continuation of the inner surfaces of said sections.

7. The module according to claim 6 wherein said sections and said strips are formed of plastics.

8. An essentially cylindrical impact attenuator module with a longitudinal axis and comprising a pair of complementary semi-cylindrical sections having inner and outer surfaces terminating in edges extending parallel to the axis of said module, means forming radially outwardly offset flanges along said edges of each section, said flanges terminating in an outwardly projecting rib, and T-shaped connector strips slidably engageable with the flanges and ribs on adjacent ones of said edges of said sections to hold said sections in assembled relation, said strips having a base slidably engageable with the inner surfaces of said flanges, a surface of said base forming a continuation of the inner surfaces of said sections.

9. The module according to claim 8 wherein said sections and said strips are formed of plastics.

10. A cylindrical assembly with a longitudinal axis and comprising a pair of complementary semi-cylindrical sections terminating in edges extending parallel to the axis of said assembly, means forming a radially outwardly offset flange along said edges of each section, said flanges terminating in an outwardly projecting rib, and a T-shaped connector strip engageable with a close sliding fit with the flanges and ribs on adjacent ones of said edges of said sections to hold said sections in assembled relation.

11. The assembly according to claim 10 wherein said strips have a base slidably engageable with the inner surfaces of said flanges, a surface of said base forming a continuation of the inner surfaces of said sections.

* * * * *